US011580923B1

(12) United States Patent
Veenbrink

(10) Patent No.: US 11,580,923 B1
(45) Date of Patent: Feb. 14, 2023

(54) DYNAMIC SHADING SYSTEM

(71) Applicant: VIDEOWINDOW B.V., Delft (NL)

(72) Inventor: Remco Veenbrink, Delft (NL)

(73) Assignee: VIDEOWINDOW B.V., Delft (NL)

( * ) Notice: Subject to any disclaimer, the term of this patent is extended or adjusted under 35 U.S.C. 154(b) by 0 days.

(21) Appl. No.: 17/500,545

(22) Filed: Oct. 13, 2021

(51) Int. Cl.

| | |
|---|---|
| ***G09G 3/36*** | (2006.01) |
| ***G09G 3/20*** | (2006.01) |
| ***G09F 19/22*** | (2006.01) |
| ***G09F 9/35*** | (2006.01) |

(52) U.S. Cl.
CPC ..... *G09G 3/3607* (2013.01); *G09F 9/35* (2013.01); *G09F 19/226* (2013.01); *G09G 3/2007* (2013.01); *G09G 2320/0285* (2013.01); *G09G 2320/0626* (2013.01); *G09G 2320/0686* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 7,134,707 | B2 | 11/2006 | Isaac | |
| 7,796,322 | B2 | 9/2010 | Ratti et al. | |
| 7,800,812 | B2 * | 9/2010 | Moskowitz | G02F 1/0121 359/275 |
| 8,098,421 | B2 | 1/2012 | Moskowitz | |
| 8,120,839 | B2 | 2/2012 | Moskowitz | |
| 8,682,750 | B2 * | 3/2014 | Mirashrafi | G06F 3/14 345/619 |
| 8,792,154 | B2 | 7/2014 | Moskowitz | |
| 9,261,752 | B2 | 2/2016 | Moskowitz | |
| 9,409,464 | B2 * | 8/2016 | Tomkins | B60J 3/04 |
| 9,507,195 | B2 | 11/2016 | Threlkel et al. | |
| 9,574,747 | B2 | 2/2017 | Paolini | |
| 9,658,509 | B2 | 5/2017 | Moskowitz | |
| 9,898,861 | B2 * | 2/2018 | Hattingh | G06T 19/00 |
| 10,001,681 | B2 * | 6/2018 | Kita | G02F 1/134363 |
| 10,040,338 | B2 * | 8/2018 | Kim | G05B 19/048 |
| 10,170,030 | B2 * | 1/2019 | Perdices-Gonzalez | G09G 3/348 |
| 10,217,392 | B2 | 2/2019 | Yu et al. | |
| 10,338,385 | B2 * | 7/2019 | Beckman | G02B 27/0103 |
| 11,017,734 | B2 | 5/2021 | Veenbrink | |
| 2006/0107616 | A1 * | 5/2006 | Ratti | G09G 3/34 52/750 |

(Continued)

FOREIGN PATENT DOCUMENTS

| | | | |
|---|---|---|---|
| EP | 2940680 | A1 | 11/2015 |
| WO | 2011014701 | A2 | 2/2011 |
| WO | 2015191597 | A1 | 12/2015 |

*Primary Examiner* — Michael J Jansen, II
(74) *Attorney, Agent, or Firm* — Steven M. Koehler; Westman, Champlin & Koehler, P.A.

(57) ABSTRACT

A dynamic shading system is disclosed. The system comprises a screen and a control system. The screen comprises a plurality of light valves. Each light valve has an adjustable translucency so that the screen can present an image on one side of the screen. The control system is configured to determine what image is to be presented on the one side of the screen in dependence of light intensity incident on another side of the screen. the control system is further configured to control each light valve of the screen to have a translucency so that the plurality of the light valves forms the determined image on the one side of the screen.

14 Claims, 8 Drawing Sheets

(56) References Cited

U.S. PATENT DOCUMENTS

| | | | | |
|---|---|---|---|---|
| 2006/0175859 | A1* | 8/2006 | Isaac | B60J 3/04 296/97.4 |
| 2007/0053053 | A1 | 3/2007 | Moskowitz | |
| 2007/0195400 | A2 | 8/2007 | Moskowitz | |
| 2008/0043316 | A2* | 2/2008 | Moskowitz | G08C 17/02 359/296 |
| 2008/0186562 | A2* | 8/2008 | Moskowitz | E06B 9/24 359/296 |
| 2010/0302624 | A1 | 12/2010 | Moskowitz | |
| 2010/0308207 | A1 | 12/2010 | Moskowitz | |
| 2011/0058113 | A1 | 3/2011 | Threlkel et al. | |
| 2011/0209319 | A1 | 9/2011 | Williams | |
| 2012/0091315 | A1 | 4/2012 | Moskowitz | |
| 2012/0233036 | A1* | 9/2012 | Mirashrafi | H04L 65/612 345/619 |
| 2014/0055433 | A1 | 2/2014 | Threlkel et al. | |
| 2014/0320946 | A1 | 10/2014 | Tomkins et al. | |
| 2014/0333990 | A1 | 11/2014 | Moskowitz | |
| 2015/0228217 | A1* | 8/2015 | Perdices-Gonzalez | G09G 3/32 345/5 |
| 2015/0354789 | A1 | 12/2015 | Paolini | |
| 2015/0371579 | A1 | 12/2015 | Yu et al. | |
| 2016/0116819 | A1 | 4/2016 | Moskowitz | |
| 2016/0148432 | A1* | 5/2016 | Hattingh | G06T 19/00 345/426 |
| 2017/0159912 | A1 | 6/2017 | Paolini | |
| 2017/0285423 | A1 | 10/2017 | Kita et al. | |
| 2018/0015811 | A1 | 1/2018 | Kim et al. | |
| 2018/0017791 | A1 | 1/2018 | Beckman | |
| 2019/0168586 | A1 | 6/2019 | Paepcke | |
| 2020/0234663 | A1 | 7/2020 | Veenbrink | |

* cited by examiner

| | 1 | 2 | 3 | 4 | 5 | 6 | 7 | 8 | 9 | 10 |
|---|---|---|---|---|---|---|---|---|---|---|
| 0 | 0 | 0 | 0 | 0 | 0 | 0 | 0 | 0 | 0 | 0 |
| 1 | 20 | 15 | 10 | 8 | 6 | 5 | 4 | 3 | 2 | 1 |
| 2 | 40 | 30 | 20 | 16 | 12 | 11 | 8 | 5 | 4 | 2 |
| 3 | 60 | 45 | 30 | 24 | 18 | 16 | 12 | 8 | 6 | 3 |
| 4 | 70 | 60 | 40 | 32 | 24 | 21 | 16 | 11 | 8 | 4 |
| 5 | 80 | 64 | 50 | 37 | 30 | 27 | 20 | 13 | 10 | 5 |
| 6 | 82 | 67 | 55 | 43 | 36 | 32 | 24 | 16 | 12 | 6 |
| 7 | 84 | 71 | 60 | 48 | 42 | 37 | 28 | 19 | 14 | 8 |
| 8 | 86 | 75 | 65 | 53 | 48 | 43 | 32 | 21 | 17 | 10 |
| 9 | 88 | 78 | 70 | 58 | 54 | 48 | 36 | 24 | 20 | 12 |
| 10 | 90 | 82 | 75 | 64 | 60 | 53 | 40 | 27 | 23 | 14 |
| 11 | 92 | 85 | 80 | 69 | 66 | 59 | 44 | 29 | 26 | 16 |
| 13 | 94 | 89 | 85 | 74 | 72 | 64 | 48 | 32 | 29 | 18 |
| 13 | 96 | 93 | 90 | 79 | 78 | 69 | 52 | 35 | 32 | 20 |
| 14 | 98 | 96 | 95 | 85 | 84 | 75 | 56 | 37 | 35 | 22 |
| 15 | 100 | 100 | 100 | 90 | 90 | 80 | 60 | 40 | 38 | 24 |

DYNAMIC SHADING SYSTEM

FIELD OF THE INVENTION

This disclosure relates to a dynamic shading system, in particular to a dynamic shading system comprising a control system that is configured to determine what image is presented on a side of the screen in dependence of light intensity incident on another side of the screen. This disclosure further relates to a computer implemented method for determining images that are to be presented on the screen and to a control system for controlling a screen of the dynamic shading system.

BACKGROUND

The discussion below is merely provided for general background information and is not intended to be used as an aid in determining the scope of the claimed subject matter.

U.S. Pat. No. 11,017,734B2 discloses a dynamic shading system that comprises a screen. The screen comprises a plurality of areas and each area has an adjustable translucency for presenting an image on one side of the screen. The shading system further comprises a control system that is configured to determine a set of translucency values that comprises a translucency value for each area for adjusting the translucency. The control system is configured to determine the set of translucency values based on at least one light intensity value indicative of a light intensity incident on another side of the screen and based on image data representative of the image to be formed by the plurality of areas.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

A dynamic shading system is disclosed. The system comprises a screen and a control system. The screen comprises a plurality of light valves. Each light valve has an adjustable translucency so that the screen can present an image on one side of the screen. The control system is configured to determine what image is to be presented on the one side of the screen in dependence of light intensity incident on another side of the screen. the control system is further configured to control each light valve of the screen to have a translucency so that the plurality of the light valves forms the determined image on the one side of the screen.

The dynamic shading system can display images while providing sufficient protection against direct or indirect sunlight. Forming an image on the screen namely involves reducing the translucency of at least some of the light valves, which also blocks at least part of the incident sunlight.

As used herein an image comprises a plurality of image elements, wherein an image element comprises adjacent, equally or similarly valued light valves of the screen (e.g. pixels). As used herein "similar" or "similarly" means that at least two pixels of the image element may have two different values; however, a human cannot readily perceive the difference and to the human they appear to be the same.

Advantageously, the dynamic shading system disclosed herein can present different images (each image comprising a different set of image elements, wherein at least one image element of a first image is not present in a second image) in response to a varying light intensity incident on the screen. As used herein, light intensity may be understood to refer to radiant flux received by a surface per unit area, which is radiant energy received by a surface per unit area, per unit time. Light intensity may for example be expressed as watt per square meter ($W/m^2$). The light intensity referred to herein may for example indicate ratio between a total radiant energy incident on the screen during some time period and a total surface area of the screen. Being able to respond to varying light intensity in terms of what content is to be presented allows to present images that are appropriate given a certain light intensity on the other side of the screen. To illustrate, if a very high light intensity is incident on the other side of the screen, for example because it is bright, sunny day, then it may be appropriate to present images that contain relatively many dark image elements. If for example a tree with leaves is to be depicted and the incident light intensity on the screen is relatively high, then it may be appropriate to present an image of the tree having relatively many leaves. The leaves, assuming that the leaves are formed on the screen by light valves having a relatively low translucency, would namely block the incident light to a relatively large extent. This may cause high user comfort in the area adjacent to the one side of the screen, e.g. in the "inside area" when the screen also functions as a border between the interior and exterior of a building.

As used herein, two different images should not be understood as two different versions of the same image. It may of course be possible to present different versions of the same image in dependence of the light incident on the screen. It may for example be possible to present a "darker" version of an image when the incident light intensity is relatively high and a "lighter" version of the image when the incident light intensity relatively low. However, this may require adjusting a contrast ratio of the image, which may hurt the visibility of the image to human observers. The dynamic shading system disclosed herein may present a different image in dependence of light intensity, for example in the sense that more "dark" image elements are added to an image with increasing light intensity in order to safeguard the shading function of the shading system, for example, as described above, where additional leaves are added to the presented image. Advantageously, the additional dark image elements do not necessarily require an adjustment of contrast ratio.

A first and a second image may be understood as different if and only if their image elements are different from each other, i.e. if at least one image element in the second image does not have a corresponding image element of the same size, shape and position in the first image, or vice versa. Thus, if one image would have some image element of certain size, certain shape at a certain relative position and if another image would be identical to the one image with the exception that it has at the certain relative position, an image element having the certain shape yet having a different size than said certain size, then the two images would be different according to the definition used herein. As used herein, if two images are said to be different then they may be understood as depicting different content.

Two versions of the same image would typically not be regarded as two different images according to the above definition. Typically, the pixels that have the same pixel value in one version of the image would still all have the same pixel value in another version of the image. For example, a selection of pixels in a first version of an image may all have value "5". Then, the same selection of pixels may all have value "6" in a second version of the image. Hence, going from one version to the other version would not cause a change of the size, shape, relative position of any image element, because an image element is defined by adjacent, equally or similarly valued pixels.

It should be appreciated that one side of the screen and the other side of the screen may be opposite each other. The other side of the screen may be a side facing the exterior of a building, for example, whereas the one side of the screen may be a side facing the interior of the building. Hence, people that are present in the interior of the building may view the images as presented on the screen and may benefit from the shading function as performed by the screen.

An image referred to herein may be understood to comprise a plurality of image pixels. As referred to herein, an image pixel may be understood as data representing the smallest element in a digital image. The light valves of the screen may be understood to be (hardware) pixels of the screen, especially if the light valves are the smallest addressable element in the screen that can have some translucency. Preferably, the first and second image consist of as many (data) image pixels as there are hardware pixels (e.g. light valves) in the screen. This namely allows to convert each pixel value of an image pixel to a translucency value for a specific hardware pixel (e.g. light valve). Each image pixel in an image may thus be associated with a specific light valve of the screen.

The control system may be configured to convert a value of an image pixel into a translucency value based on which the translucency of a light valve can be controlled.

Determining an image that is to be presented on the basis of incident light intensity may comprise generating the image based on a light intensity value indicative of light intensity incident on the other side of the screen. Thus, the determined image to present need not be prestored on some computer-readable storage media (and subsequently be selected), but may be generated on the fly.

The method may be performed repeatedly, for example in the sense that images are determined repeatedly based on incident light intensity. The determined images may then be presented on the screen sequentially, one after the other, so that they form a movie. In such case, the movie may be said to be automatically generated based on incident light intensity. Such movie may also be referred to as a generative video.

As referred to herein, a movie may be understood to consist a sequence of still images, also referred to as frames or video frames, that when presented in sequence or successively form a moving image, i.e. form the movie.

In an embodiment, the control system is configured to perform steps of:

obtaining a first light intensity value indicative of a first light intensity incident on another side of the screen, and determining, based on the first light intensity value, a first to-be-presented image, and controlling each light valve of the screen to have a translucency so that the plurality of the light valves forms the first image on the one side of the screen, and obtaining a second light intensity value indicative of a second light intensity incident on the another side of the screen, the second light intensity value being different from the first light intensity value, and determining, based on the second light intensity value, a second to-be-presented image, the second image being different from the first image, and controlling each light valve of the screen to have a translucency so that the plurality of light valves forms the second image on the one side of the screen.

In such embodiment, the first and second image may each comprises one or more image elements formed by adjacent image pixels having the same or similar pixel values. Each image element then has a respective size and shape and relative position within the image in question. Further, the first and second image differ in that a particular image element in the second image, the particular image element having a particular size and particular shape and particular relative position, does not have in the first image a corresponding image element having the same particular size and the same particular shape and the same particular relative image position.

The second light intensity may be incident on the screen at a later time than the first light intensity incident on the screen. Their difference may be caused for example by the weather changing, for example because it has become cloudy or that clouds have disappeared, for example.

As referred to herein, a light intensity value indicative of light intensity incident on the other side of the screen may be a temperature value indicative of an area adjacent the one side of the screen. The temperature in the area adjacent the one side of the screen may namely be understood to be indicative of a light intensity, in particular of an infrared light intensity, incident on the screen. Thus, determining what image is to be presented on the one side of the screen in dependence of light intensity incident on another side of the screen may be performed by determining what image is to be presented on the one side of the screen in dependence of a temperature in an area adjacent to the one side of the screen, for example.

The difference between the determined first and second image is at least partially caused by the second light intensity being different from the first light intensity. Thus, the incident light intensity influences what image is presented. Determining the first image may comprise determining one or more image elements of the first image based on the first light intensity value and determining the second image may comprise determining one or more image elements of the second image based on the second light intensity value.

The first and second image may be determined for some future time, for example for a time five seconds after having obtained the first and resp. second light intensity value.

The first and second image may both be still images that are part of the same movie. If this is the case, then the first and second image may also be referred to as "frames" or "video frames" of that movie. To illustrate, the control system may be configured to determine a to-be-presented movie by determining the first and second image as per above, and determining many more images based on further light intensity values indicative of respective light intensities incident on the screen. The sequence of all determined images will then define the movie that is to be presented. It should be appreciated that a movie may thus be generated on the fly on the basis of a current light intensity incident on the screen. To this end, generative video algorithms may be used that use as input light intensity values indicative of respective light intensities incident on the screen. Examples of generative video algorithms are L-shapes, boids, physarum.

In an embodiment, determining the first to-be-presented image comprises determining a first set of image pixel values, e.g. greyscale values, comprising, for each light valve of the screen, an image pixel value. The first set of image pixel values represents the first image. In such embodiment, determining the second to-be-presented image may comprise determining a second set of image pixel values, e.g. greyscale value, comprising, for each light valve of the screen, an image pixel value. The second set of image pixel values represents the second image.

This embodiment advantageously allows to process commonly used greyscale values. In general, for regions in an image having higher greyscale values, i.e. for brighter or lighter regions in an image, the control system controls the associated light valves to have higher translucency values.

In an embodiment, the control system is configured to perform a step of determining, for each light valve out of the plurality of light valves, a first translucency value. In such embodiment, controlling each light valve of the screen to have a translucency so that the plurality of the light valves forms the first image on the one side of the screen may be performed based on the first translucency values determined for the respective light valves. In such embodiment, the control system may be configured to perform a step of determining, for each light valve out of the plurality of light valves, a second translucency value. Then, controlling each light valve of the screen to have a translucency so that the plurality of the light valves forms the second image on the one side of the screen may be performed based on the second translucency values determined for the respective light valves.

Any translucency value for a light valve described herein may be understood to indicate a translucency of the light valve in question, e.g. a target translucency of the light valve in question. Such translucency value may be expressed in a percentage or other ratio indicating which part of the incident light intensity passes through the light valve in question. For example, a ratio of 100% may be understood as that the light valve in question is fully translucent, e.g. in the sense that substantially all light intensity passes through the light valve in question. A ratio of 0% may be understood as that the light valve in question fully blocks light incident on the light valve in question, e.g. in the sense that substantially no light intensity passes through the light valve in question.

Of course, preferably, the first translucency value for each light valve is determined on the basis of the first image and the second translucency value for each light valve is determined on the basis of the second image, preferably in such manner that for light valves that are to depict brighter/lighter regions of the image relatively high translucency values are determined and in such manner that for light valves that are to depicts darker regions of the images, relatively low translucency values are determined.

In particular, the control system may be configured, if each image pixel of the first/second image is associated with a light valve, to convert each image pixel value, e.g. greyscale value, to a translucency value for the light valve associated with the image pixel in question. Preferably, such conversion is performed based on the light intensity that is incident on the other side of the screen as also described in U.S. Pat. No. 11,017,734B2, which is incorporated herein by reference in its entirety.

It should be appreciated that, once the first image has been determined, wherein the first image comprises a plurality of image pixels having respective image pixel values, the appropriate translucency values for the light valves, in one embodiment, may be determined based on solely the image pixel values without taking into account any light intensity value. In such case, the light intensity value is only used for determining what image is presented on the screen; however, the light intensity value does not play any role how the determined image is presented in the screen, i.e. the light intensity value does not play any role in determining the actual translucency values for the light values used for presenting the image.

In contrast, in another embodiment, the first translucency value for each light valve is determined on the basis of a light intensity value indicative of light intensity incident on the other side of the screen when the plurality of the light valves will form the first image on the one side of the screen. This light intensity value may simply be the first light intensity value. In that case, the first light intensity value may be understood to be indicative of light intensity incident on the other side of the screen when the plurality of the light valves will form the first image on the one side of the screen. However, since the first image may be presented some time after it has been determined, e.g. because the first image is a still image or frame of a video or movie comprising multiple still images or frames, which still image is displayed at some playtime of the movie, the first translucency value for each light valve may be determined based on a light intensity value indicating a light intensity incident on the screen at a moment that is closer to the moment at which the first image is actually presented. Likewise, the second translucency value for each light valve may be determined on the basis of a light intensity value indicative of light intensity incident on the other side of the screen when the plurality of the light valves will form the second image on the one side of the screen.

This embodiment allows to, once it has been determined what image is going to be presented, ensure that a proper well-visible version of the image is presented on the screen. In this embodiment, the techniques described in U.S. Pat. No. 11,017,734B2 can be suitably used as well. This publication namely describes techniques to, given that a certain image is to be formed, control the translucency of the light valves such that the image is clearly visible while at the same time the shading function is maintained.

The second light intensity as indicated by the second light intensity value may be higher than the first light intensity as indicated by the first light intensity value. In such case, on average, the second image is darker than the first image. In an example, the second image comprises more image relatively dark image elements than the first image. In such case, when the screen is presenting the second image, more light valves will have a low translucency than when the screen is presenting the first image, as a result of which more light will be blocked when presenting the second image, as appropriate. For example, the first and second image may both depict a tree with leaves. In such case, the first image may depict a tree having only few leaves, whereas the second image may depict a tree having relatively many (dense) leaves. Presenting the second image on the screen then in principle blocks more incident light than presenting the first image (assuming that the contrast ratio for both images is comparable).

The second image being, on average, darker than the first image may also be referred to as that an average brightness value of the second image is lower than an average brightness value of the first image. In general, determining an average brightness value of an image may comprise (i) determining, for each image pixel, a brightness value and then (ii) determining an average of all determined brightness values. Herein, determining a brightness value for a pixel for a greyscale image can be performed relatively simply. In a greyscale image, the value of each image pixel namely directly indicates the brightness value. Typically, lower greyscale values correspond to lower brightness values and higher greyscale values correspond to higher brightness values. Determining a brightness value for an RGB pixel may comprises performing a calculation such as R+G+B, or (0.2126*R+0.7152*G+0.0722*B), or (0.299*R+0.587*G+0.114*B), wherein R, G, B indicate the intensity of respectively the red, green, blue component for a pixel.

In an embodiment, the control system is configured to determine what movie is to be presented on the one side of the screen in dependence of light intensity on the other side of the screen. The movie may be understood to consist of a number of still images, that when presented sequentially, form the movie. As referred to herein, a movie may be understood to be a sequence of still images that, when played sequentially, depict a moving image. This embodiment enables that suitable movies are presented on the screen based on the light intensity value indicative of light intensity incident on the other side of the screen.

In an embodiment, determining the movie that is to be presented comprises generating the to-be-presented movie based on a light intensity value indicative of the light intensity that is incident on the screen.

In an embodiment, the control system is optionally configured to perform steps of determining, based on the first light intensity value, a first to-be-presented movie, the first to-be-presented movie comprising the first to-be-presented image, and controlling each light valve of the screen to sequentially have first translucencies so that the plurality of the light valves forms the first movie on the one side of the screen, and determining, based on the second light intensity value, a second to-be-presented movie different from the first to-be-presented movie, the second to-be-presented movie comprising the second to-be-presented image, and controlling each light valve of the screen to sequentially have second translucencies so that plurality of light valves forms the second movie on the one side of the screen.

In this embodiment, the first and second image may be understood to be still images in the first and second movie, respectively.

As referred to herein, a first movie and a second movie may be understood to be different from each other if for at least one pair of images consisting of a first still image out of the first movie and a second still image out of the second movie, the first still image being associated with a certain playtime in the first movie and the second still image being associated with the same certain playtime in the second movie, the first still image is different from the second still image in the sense that at least one image element in the second still image does not have a corresponding image element of the same size, shape and relative position in the first still image, or vice versa.

The first and second movie may have a playtime of for example a few seconds. The first and second movie may be presented one after each other so that a user perceives them as one movie. [sequence of frames]

In case the second light intensity as indicated by the second light intensity value is higher than the first light intensity as indicated by the first light intensity value, on average, the second video may be darker than the first video. For example because the still images of the second video comprise more relatively dark image elements.

In an embodiment, determining the first movie comprises generating the first movie based on the first light intensity value and/or wherein determining the second movie comprises generating the second movie based on the second light intensity value.

In this embodiment, the control system is able to generate movies automatically. Such automatic generation of a movie may also be referred to as generative video art. In such embodiment, the generated movie is generated based on the light intensity incident on one side of the screen. The light intensity incident on the screen may be understood to influence what movie content is presented on the screen.

In an embodiment, the first and/or second image depicts one or more plants and/or animals. Preferably, the first and/or second image are photorealistic images. The inventors have found that images or movies depicting plants, especially images or movies depicting leaves on a tree, cause shadows in an area adjacent the one side of the screen, e.g. in the interior area of a building, which shadows on itself cannot be distinguished from shadows that would be provided by real trees. As a consequence, the user comfort that is provided by such biophilic images is significant.

Additionally or alternatively, the first and/or second image depicts abstract figures.

In case the second light intensity as indicated by the second light intensity value is higher than the first light intensity as indicated by the first light intensity value, and in case the first video and the second video depict growth of one or more plants, then the depicted growth in the second movie may be faster than the depicted growth in the first movie. The growth in the second video may be faster in the sense that the second video will comprise more relatively dark image elements faster than the first video. To illustrate, both the first and the second video may depict the growth of a tree developing leaves. In such case, the leaves may develop faster in the second video than in the first video, so that on average the second video is darker and causes lower translucency values for the light valves forming the second video, as appropriate given the higher light intensity on the screen.

In an embodiment, each light valve comprises a liquid crystal display (LCD) pixel.

In an embodiment, the dynamic shading system comprises a light intensity sensor for measuring light intensity incident on the other side of the screen.

As explained above, a temperature sensor for measuring the temperature in an area adjacent the one side of the screen may also be used as light intensity sensor for measuring light intensity incident on the other side of the screen, because the temperature in the adjacent area may be understood to be indicative of the light intensity, in particular of the infrared light intensity, incident on the screen.

However, it should be appreciated that such light intensity sensor is not strictly required. It is for example also possible to receive weather forecasts indicative of the light intensity incident on the other side of the screen for future times. Based on these weather forecasts, the first and second image may be determined as well, and subsequently formed by the light valves of the screen.

One aspect of this disclosure relates to a computer-implemented method for determining images that are to be presented on a side of a screen in dependence of light intensity incident on another side of the screen, the screen comprising a plurality of light valves, each light valve having an adjustable translucency so that the screen can present an image on one side of the screen. The method comprises obtaining a light intensity value indicative of a light intensity incident on the other side of the screen, and determining, based on the light intensity value, what image is to be presented on the one side of the screen, and controlling each light valve of the screen to have a translucency so that the plurality of the light valves forms the determined image on the one side of the screen.

In an embodiment, the method comprises obtaining a first light intensity value indicative of a first light intensity incident on another side of the screen, and determining, based on the first light intensity value, a first to-be-presented image, and controlling each light valve of the screen to have a translucency so that the plurality of the light valves forms the first image on the one side of the screen, and obtaining a second light intensity value indicative of a second light intensity incident on the another side of the screen, the second light intensity value being different from the first light intensity value, and determining, based on the second light intensity value, a second to-be-presented image, the second image being different from the first image, and controlling each light valve of the screen to have a translucency so that plurality of light valves forms the second image on the one side of the screen, wherein the first and second image each comprises one or more image elements formed by adjacent image pixels having the same or similar pixel values, each image element having a respective size and shape and relative position within the image in question, wherein the first and second image differ in that a particular image element in the second image, the particular image element having a particular size and particular shape and particular relative position, does not have in the first image a corresponding image element having the same particular size and the same particular shape and the same particular relative image position.

One aspect of this disclosure relates to a control system for use in any of the dynamic shading systems described herein, the control system being configured to perform any of the methods as performed by the control system described herein.

One aspect of this disclosure relates to a non-transitory computer-readable storage medium having stored thereon a computer program comprising instructions which, when the program is executed by a computer, cause the computer to carry out any of the methods as performed by the control system described herein.

One aspect of this disclosure relates to a computer comprising a a computer readable storage medium having computer readable program code embodied therewith, and a processor, preferably a microprocessor, coupled to the computer readable storage medium, wherein responsive to executing the computer readable program code, the processor is configured to perform any of the methods as performed by the control system described herein.

One aspect of this disclosure relates to a computer program or suite of computer programs comprising at least one software code portion or a computer program product storing at least one software code portion, the software code portion, when run on a computer system, being configured for executing out any of the methods as performed by the control system described herein.

As will be appreciated by one skilled in the art, aspects of the present invention may be embodied as a system, a method or a computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Functions described in this disclosure may be implemented as an algorithm executed by a processor/microprocessor of a computer. Furthermore, aspects of the present invention may take the form of a computer program product embodied in one or more computer readable medium(s) having computer readable program code embodied, e.g., stored, thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples of a computer readable storage medium may include, but are not limited to, the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of the present invention, a computer readable storage medium may be any tangible medium that can contain, or store, a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber, cable, RF, etc., or any suitable combination of the foregoing. Computer program code for carrying out operations for aspects of the present invention may be written in any combination of one or more programming languages, including an object oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems), and computer program products according to embodiments of the present invention. It will be understood that each block of the flowchart illustrations and/or block diagrams, and combinations of blocks in the flowchart illustrations and/or block diagrams, can be implemented by computer program instructions. These computer program instructions may be provided to a processor, in particular a microprocessor or a central processing unit (CPU), of a general purpose computer, special purpose computer, or other programmable data processing apparatus to produce a machine, such that the instructions, which execute via the processor of the computer, other programmable data processing apparatus, or other devices create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

Moreover, a computer program for carrying out the methods described herein, as well as a non-transitory computer readable storage-medium storing the computer program are provided. A computer program may, for example, be downloaded (updated) to the existing systems (e.g. to the existing control systems) or be stored upon manufacturing of these systems.

Elements and aspects discussed for or in relation with a particular embodiment may be suitably combined with elements and aspects of other embodiments, unless explicitly stated otherwise. Embodiments of the present invention will be further illustrated with reference to the attached drawings, which schematically will show embodiments according to the invention. It will be understood that the present invention is not in any way restricted to these specific embodiments.

BRIEF DESCRIPTION OF THE DRAWINGS

Aspects of the invention will be explained in greater detail by reference to exemplary embodiments shown in the drawings, in which.

DETAILED DESCRIPTION OF THE DRAWINGS

In the figures identical reference numbers indicate identical or similar elements.

Figure 1:
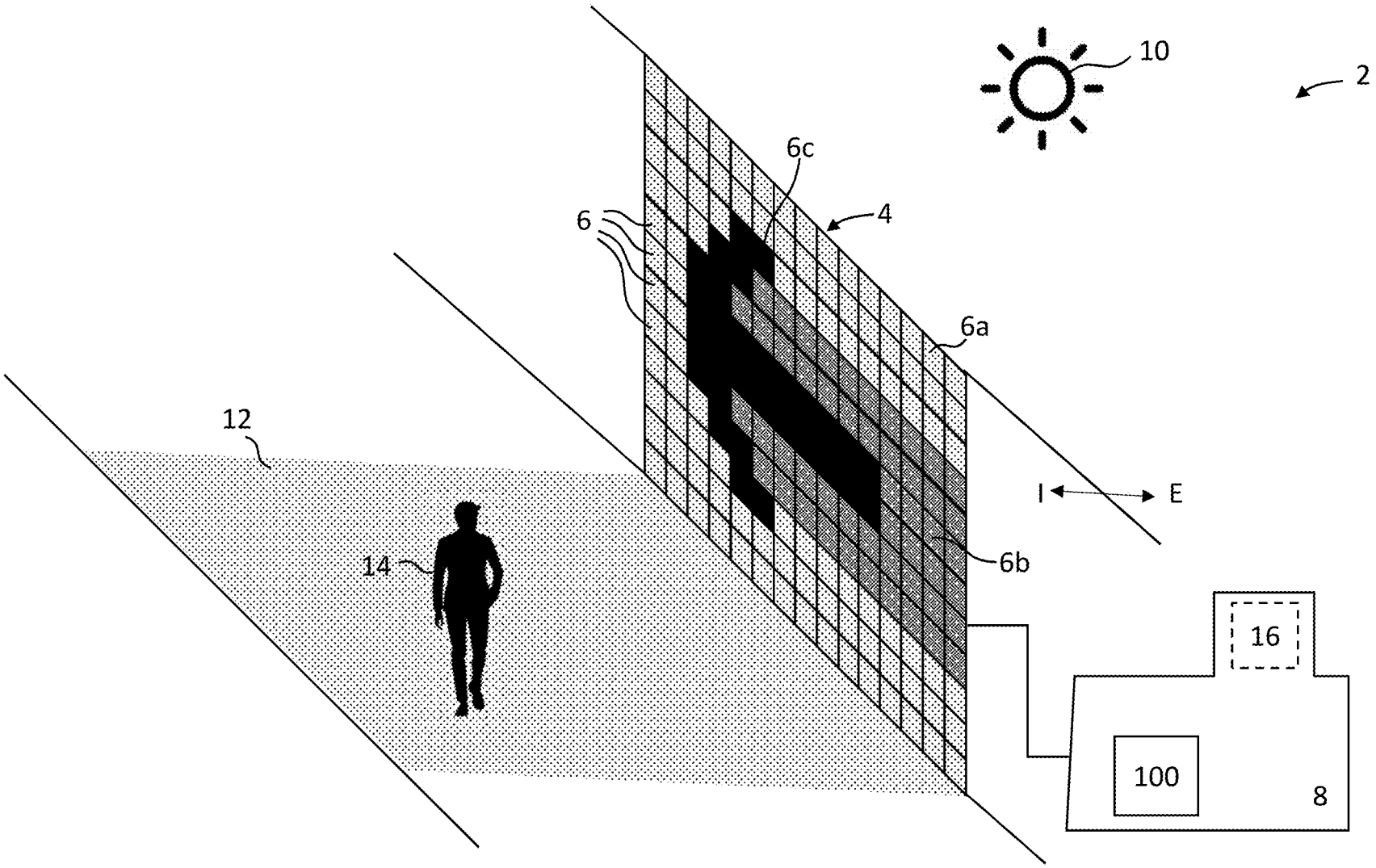
FIG. 1 depicts a dynamic shading system according to one embodiment.

FIG. 1 depicts a dynamic shading system 2 according to one embodiment. The system 2 comprises a screen 4 and a control system 8.

The screen 4 comprises a plurality of light valves 6 that have an adjustable translucency, e.g. an adjustable transparency. The screen 4 provides protection from a light source 10, such as the sun, and can thus protect against UV and/or IR radiation, and/or against glare caused by direct incident light from the light source and/or against high perceived brightness caused by direct or indirect light from the light source. In one example, the screen is placed near a boundary between the interior I of a building and the exterior E. In FIG. 1, the screen 4 forms such boundary, e.g. is used as a façade. The screen 4 may cast a shadow that provides a comfortable area 12 wherein an observer 14 does not experience glare and/or wherein a temperature is kept suitably low as a result of the screen 4 blocking incident sunlight.

The light intensity incident on the screen 4 may be a measure of a (time averaged) amount of radiant power incident on the screen 4. The light valves 6 may be unable to generate light autonomously, e.g. without the areas being backlit. In one embodiment, the sun is used as a variable backlight source. As a result, during operation, the screen may consume less than 10 $W/m^2$, for example less than 4 $W/m^2$.

Since the translucency of a light valve 6 relates to an amount of light passing through the light valve 6, it also relates to a perceived brightness of the light valve 6. Hence, given a certain light intensity incident on the screen 4, a high translucency of the light valve 6 relates to a high perceived brightness of the light valve and a low translucency value of a light valve relates to a low perceived brightness of the light valve 6. The screen 4 may be said to use the incident light as a variable backlight for displaying images.

The plurality of light valves 6 may be LCD pixels. The plurality of light valves 6 may be regularly arranged. In particular, the plurality of light valves may be regularly arranged pixels. The height and/or the width of each light valve may be in the range 0-20 m, preferably 0 mm-5 m, more preferably 5-50 mm or <1 mm. In one example, each light valve is a pixel sized 14.7 mm by 16.4 mm. The screen has a height and a width, wherein the height may be 1-10 m, preferably 1-3 m and the width may be in the range of 0.5-500 m, preferably 4-200 m, more preferably 8-100 m. In one example, the screen is sized 3.4 m by 6.85 meters. The screen may comprise 3428 light valves per $m^2$. The screen may comprise approximately 2.000.000 pixels per 1.25 $m^2$ (1920×1080 pixels on 1.44 m×0.82 m, for example).

The light valves 6 may be electronically controllable. In one embodiment, the translucency of each area may be dependent on an electrical current or voltage being applied to the light valve 6. The control system 8 may be configured to apply a specific electrical current or a specific voltage to each light valve 6 for controlling the translucency of each light valve 6, for example by applying pulse width modulation (PWM). Each light valve may comprise a transistor, such as Thin Film Transistor, that is configured to control a voltage that is provided to, for example, the liquid crystal display pixel. Each Thin Film transistor may receive the same driving voltage.

The translucency of a light valve and the to be applied voltage/current may or may not possess a linear relationship. The translucency of a light valve and the voltage/current applied to it may possess a negative or positive relationship. In an example, said relationship is negative and a zero applied voltage/current will result in the light valves having a high translucency, e.g. a high transparency. Hence, if a power failure occurs, beneficially the screen will not revert to an all-black state wherein it blocks substantially all incident light.

The control system 8 may be configured to separately adjust the translucency of each light valve 6. The control system may be configured to control the translucency of each light valve 6 to become either of two values, for example a first maximum value corresponding to a maximum percentage, preferably 100% or close to 100%, of incident light intensity passing through the light valve 6 and corresponding to a maximum brightness of the area given the circumstances and to a second minimum value corresponding to a minimum percentage, preferably 0% or close to 0%, of incident light intensity passing through the light valve 6 and corresponding to a minimum brightness, preferably blackness, of the light valve 6. The translucency of each area 6 may be adjustable to a wide range of values and the control system 8 may be configured to control the translucency of each light valve 6 to be any value between said minimum and maximum value, i.e. the translucency may be controlled in a stepless manner. In an example, the control system 8 is configured to control the translucency of each light valve 6 to be one value out of a fixed number of values. Said fixed number of values is for example two, three, five, ten, sixteen, et cetera. Said fixed number of values may depend on the number of bits that represent a greyscale value as explained below. In a particular example, 8 bits are used for representing the possible greyscale values for an image pixel value. In such case, the image pixel value can have 256 different values.

In FIG. 1, the control system 8 is shown to control the light valves 6*a* to have a high translucency, light valves 6*b* to have an intermediate translucency, and light valves 6*c* to have a low translucency. Hence, an observer 14 perceives area 6*a* as lighter than area 6*b*, and perceives area 6*b* as lighter than area 6*c*. The observer may perceive area 6*a* as white, even if area 6*a* has a translucency lower than 100%, and area 6*c* as black. The control system 8 may be configured to adjust the translucency of the light valves at least 25 times per second, preferably at least 60 times per second.

Thus, in the depicted embodiment, since the control system 8 is configured to determine what image is to be presented on the one side of the screen in dependence of light intensity incident on the other side of the screen, that an arrow of a certain size is to be presented on the screen.

Optionally, the dynamic shading system comprises a light intensity sensor for measuring light intensity incident on the other side of the screen. The sensor 16 may be positioned on the light receiving side of the screen 4 and/or on another side of the screen. In the latter example, the sensor 16 may be positioned to measure an amount of light intensity passing through one or more light valves. These one or more light valves may then be controlled to adopt one or more predetermined translucencies, e.g. cycle through a number of translucencies, and the control system may be configured to associate each predetermined translucency value with a light intensity passing through the one or more areas. Based on this, an indication of the light intensity incident on the screen may be determined. The light intensity value indicative of the light intensity incident on the screen may be an indication of the ambient light's intensity. In one example, the shading system comprises multiple light intensity sensors 16, for example a first light intensity sensor for at least one light valve and a second light intensity sensor for at least one other light valve. In one example, the control system comprises at least one light intensity sensor per light valve. The sensor 16 advantageously enables the shading system to quickly adapt to changing lighting conditions.

Optionally, the control system 8 comprises a person sensor, e.g. e movement sensor, that is configured to detect a person 14 near the screen, e.g. on said one side of the screen, and in response output a signal, and the control system 100 may be configured to control the light valves based on this signal. This advantageously allows the system to for example temporarily improve its glare control function or climate control function when a person 14 passes by the screen 4.

The control system may also be configured to connect to other devices, for example using Internet of Things technology known in the art. As such, the control system and the dynamic shading system can be a part of a smart façade of a building and can be used in Smart Building applications. The control system may for example be configured to connect to mobile devices of respective users, so that the users can control, to some extent, the images that are presented on the screen. In one example, users can, via their respective mobile device, e.g. smart phones, play interactive games on the screen against each other. To this end, the control system may be configured to receive control signals from a plurality of mobile devices.

In one embodiment, the control system 8 comprises a user interface through which a user can change settings of the shading system and/or input light intensity values.

The control system 8 may be embodied as a data processing system 100 further described below.

In one embodiment, each light valve comprises an adjustable translucency in the sense that each light valve comprises an adjustable transparency, which transparency the control system 8 is configured to control. Transparency may thus be regarded as a species of translucency. If an area has a high transparency value, then not only does a relatively large percentage of incident light intensity passes through the area, also an observer 14 at one side of the area can clearly see objects at the other side of the area, because light passing through the area does not scatter. This embodiment allows to construct transparent shading systems. In other words, the screen of the system may be transparent screen.

Figure 2A:
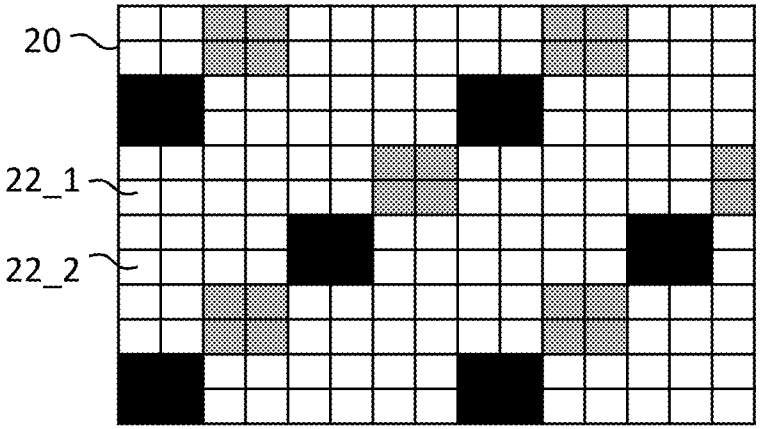
FIGS. 2A-2D illustrate how two images may be understood to be different from each other.
Figure 2B:
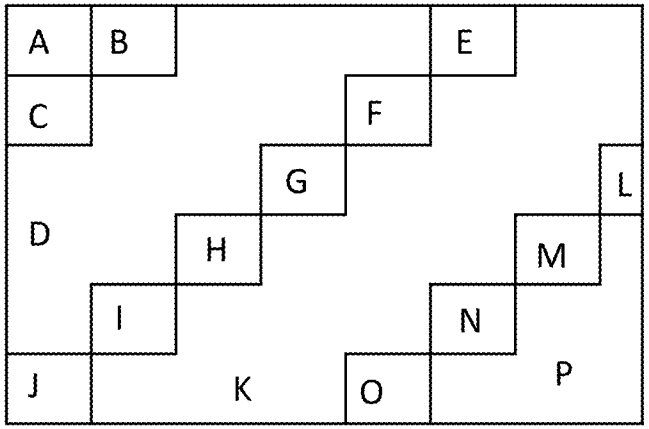
Figure 2C:
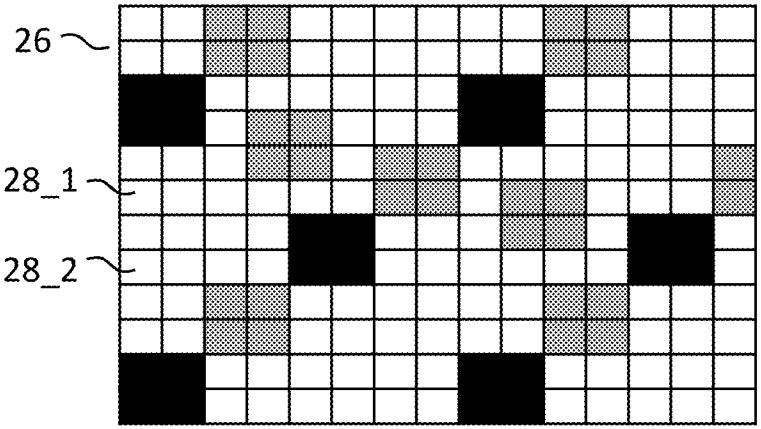

FIGS. 2A-2D illustrate how two images may be understood to be different from each other. FIG. 2A shows a first image 20 and FIG. 2C shows a different, second image 26. The first and second image comprise images pixels 22, 28, respectively, i.e. the rectangular areas in the images. Each image pixel may be understood to be a data structure indicating a relative position in an image as well as one or more intensities for that relative position, e.g. a greyscale value or RGB values. In FIGS. 2A and 2C pixels 22_1 and 28_1 may be understood to have the same relative position within the image, being the sixth pixel from the top and the first pixel from the left of the images. Likewise, the pixels 22_2 and 28_2 also have the same relative position.

The first image 20 and the second image 26 are both greyscale images in the sense that each image pixel is associated with a single brightness value indicating the brightness for the image pixel in question. Herein, white image pixels may be understood to have a relatively high brightness, black image pixels a relatively low brightness and grey pixels a relatively intermediate image pixel.

Figure 2D:
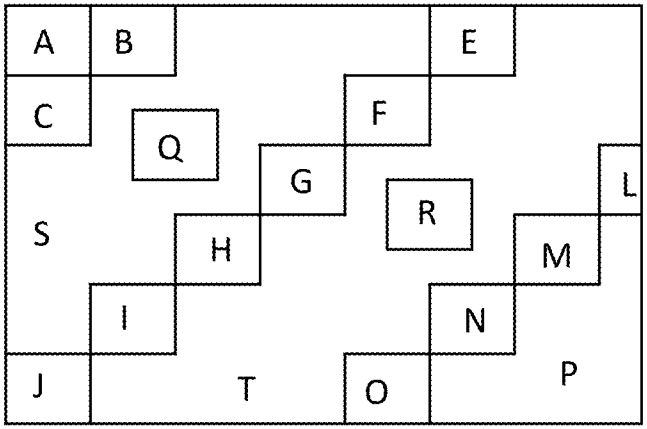

FIG. 2B shows the image elements A-P for the first image and FIG. 2D shows the image elements A-C, E-J and L-R for the second image. As is clear from these figures, image elements are formed by adjacent image pixels having the same or similar pixel values. To illustrate, image element A in first image 20 (and also image element A in second image 26) is formed by four adjacent image pixels (the four adjacent image elements being illustrated in FIGS. 2A and 26) that all have the same value, namely the relatively high brightness value. The same holds for image elements D, K, P in first image 20. Also, image element B in first image 20 (and also image element B in second image 26) is formed by four adjacent image pixels all having the intermediate brightness value. The same holds for image elements E, G, I, L, N.

Each image element shown in FIGS. 2B and 2D has a respective size and shape and relative position within the image in question. To illustrate, image element C has a size of 2 pixels wide and 2 pixels height, a relative position of (0,8), and a rectangular shape. Note that the position of image element C is indicated by the coordinates of the top left of the image element, wherein "0" indicates that the top left sits at zero x-displacement (horizontal displacement in the figure) from the left side of the image and "8" indicates a displacement of eight times a pixel height in the y-direction (the vertical direction in the figure) from the bottom of the image.

Image element C in the first image 20 has a corresponding image element in the second image 26, namely image element C in the second image 26. Image element C in the second image 26 namely also has a size of 2 pixels wide and 2 pixels height, a relative position of (0,8), and a rectangular shape.

However, the second image comprises at least one image element, in the embodiment illustrated, namely image elements Q, R, S and T, each of which does not have a corresponding image element in the first image 20. To illustrate, image element S in the second image has a different shape than the image element D in the first image. Image element S namely has a hole in the middle there where image element Q is present, whereas image element D does not comprise such hole. The same applies, mutatis mutandis for image element T and K. Hence, the second image (FIGS. 2B, 2D) may be understood different from the first image (FIGS. 2A, 2C).

In FIGS. 2B and 2D, the identified image elements are formed by adjacent pixels having equal image pixel values. However, they may also be formed by adjacent pixels having similar pixel values in the sense that all image pixels in an image element have an image pixel value within a certain range. It should be appreciated that multiple, preferably non-overlapping, ranges may be used for identifying the image elements. Further, it should be appreciated that the ranges used for identifying image elements in the first image may be different from the ranges used for identifying image elements in the second image.

The control system may thus be configured to determine that the first image 20 is to-be-presented on the screen based on a first light intensity value and that the second image 26 is to be presented based on a second light intensity value. Note that the second image is on average darker than the first image because the average brightness values of the image pixels of the second image is lower than the average brightness value of the image pixels of the first image. Thus, the second image enables to the shading system to better perform a shading function, which would be appropriate if high light intensities are incident on the screen.

Figure 3A:
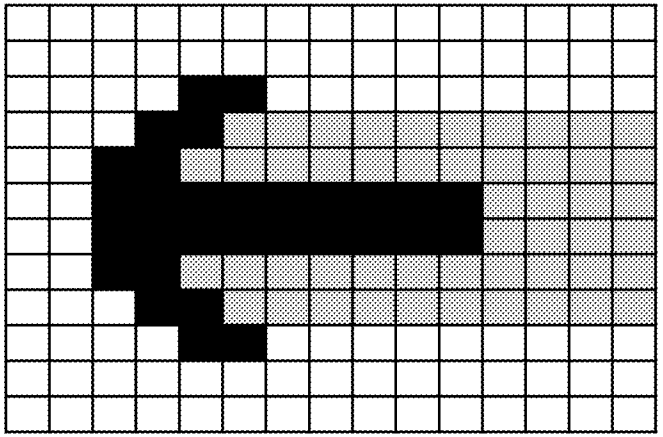
FIGS. 3A-3D illustrate different versions of the same image.
Figure 3B:
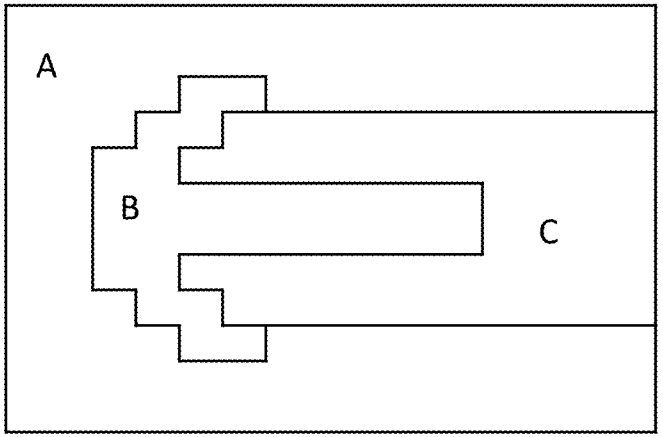
Figure 3C:
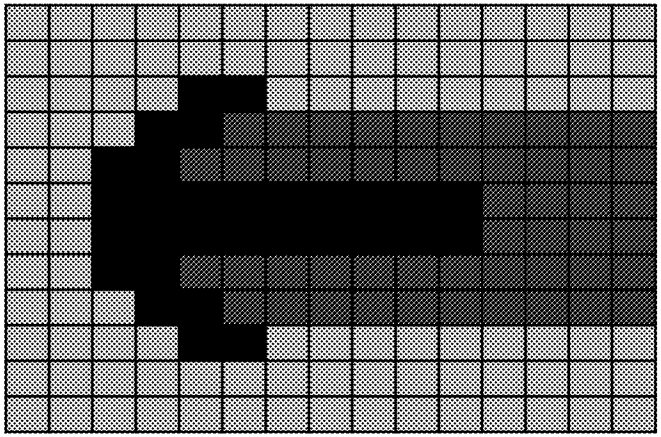
Figure 3D:
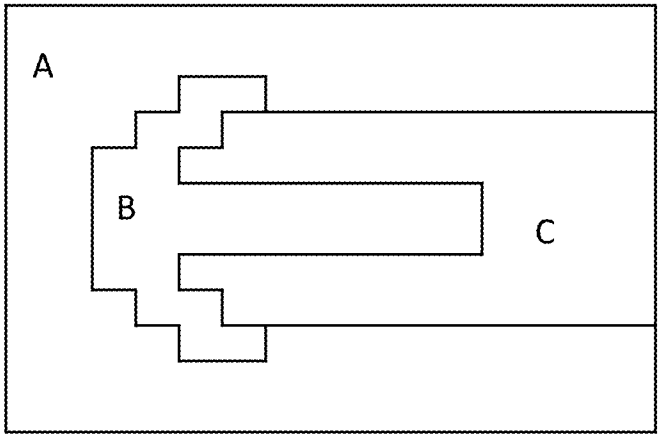

FIG. 3A-3D illustrate an example in which two images may be understood as being the same, in particular as being different versions of the same image. FIG. 3A shows a first image and FIG. 3B a second image. The second image is a darker version and the first image a brighter version. FIG. 3B shows the image elements of FIG. 3A and FIG. 3D shows the image elements of the image in FIG. 3C. Clearly, each image element A, B, C has a corresponding image element of the same size, relative position and shape in the first image. Therefore, the first and second image depicted in FIG. 3A and FIG. 3C may be understood to be the same image.

Figures 4, 5:
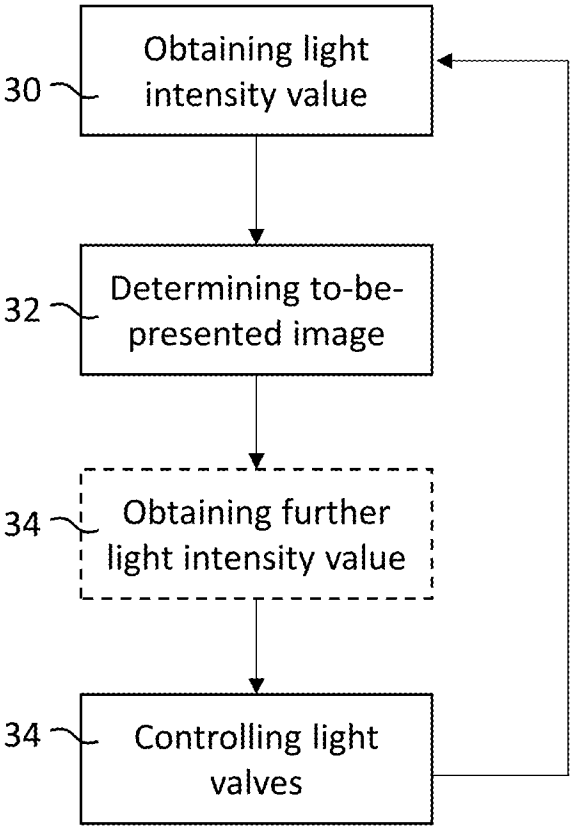
FIG. 4 illustrates a method for determining to be presented images.
FIG. 5 illustrates a particular method for determining a translucency value for each light valve

FIG. 4 illustrates an, optionally computer-implemented, method for determining images that are to be presented on a side of a screen in dependence of light intensity incident on another side of the screen, the screen comprising a plurality of light valves, each light valve having an adjustable translucency so that the screen can present an image on one side of the screen. The method comprises a step 30 of obtaining e.g. receiving, a light intensity value indicative of a light intensity incident on the other side of the screen. The light intensity value may be received from a light intensity sensor described herein and/or may be determined based on weather forecasts. The method further comprises a step 32 of determining, based on the light intensity value, what image is to be presented on the one side of the screen. This step may comprise determining a set of image pixel values comprising, for each light valve of the screen, an image pixel value, the set of image pixel values representing the image.

Then, once it has been determined what image is going to be presented, the dynamic shading system may determine translucency values for the respective light valves of the system so that indeed the determined image is properly rendered on the screen. Such translucency values may then be used to control the translucency of the light valves. Determining such translucency values may be a relatively straightforward conversion from image pixel values to translucency values. However, as explained in FIG. 5, such conversion may also take into account incident light intensity. This may be performed by determining the translucency values based on the light intensity value used for determining what image is to be presented. Alternatively, converting image pixel values into translucency values may also be based on a light intensity that is incident on the screen at a later time, e.g. at a time when the determined image is actually going to be rendered. Hence, the method comprises an optional step 34 of obtaining a further light intensity value indicative of light intensity incident on the other side of the screen when the plurality of the light valves will form the determined image on the one side of the screen.

The method also comprises a step 34 of controlling each light valve of the screen to have a translucency so that the plurality of the light valves forms the determined image on the one side of the screen. This step may of course be performed based on the translucency values that are optionally determined for the light valves.

Preferably, the method is performed repeatedly so that the images that are presented on the screen remain appropriate for the current incident light intensity, as indicated by the arrow from step 34 to step 30. Such repeatedly determined images may be still images of a movie. Hence, the method can be used for generating a movie based on light intensity values indicative of respective light intensities incident on the screen at respective times.

FIG. 5 shows a table that illustrates a particular method for determining a translucency value for each light valve.

The top row shows light intensity values 1-10 (arbitrary units). Higher light intensity values are indicative of higher light intensities being incident on the screen 4. The most left column shows greyscale values 0-15. In this example, a greyscale value of 0/15 is associated with black, whereas a greyscale value of 15/15 is associated with white. Each combination of light intensity value and greyscale value corresponds with a translucency value. In this example, each translucency value is expressed as a percentage of incident light that passes through the light valve.

Thus, if a to be presented image has a particular image pixel associated with a particular light valve, wherein the particular image pixel has a value of 10/15, and a light intensity value has a value of 5/10, then the translucency value for the particular light valve will be 60%. Note that the light intensity value used for this determination may be the same light intensity value used for determining what image is to be presented or a light intensity value indicative of the incident light intensity at a later time.

It should be appreciated that determining a translucency value may comprise simply converting a greyscale value to a translucency value without taking into account any light intensity value.

In an embodiment, the control system 8 is configured to perform the step of storing data associating combinations of light intensity value and greyscale value with translucency values. The control system may further be configured to perform the step of transforming the image pixel values into translucency values based on said transformation data. In one example, the control system may thus have stored the table as depicted in FIG. 5. Advantageously the control system then may only have to look up an associated translucency value given a light intensity value and given an image pixel value. In an example, during a preproduction process, for each light valve and for every time instant in a movie, a table such as depicted is determined and these tables are stored by the control system for use during the display of the movie.

Said transformation data may comprise one or more predefined mathematical operations and in one embodiment, the control system is configured to perform the step of calculating for each image pixel value the associated translucency value using the one or more predefined (mathematical) operations.

Figure 6A:
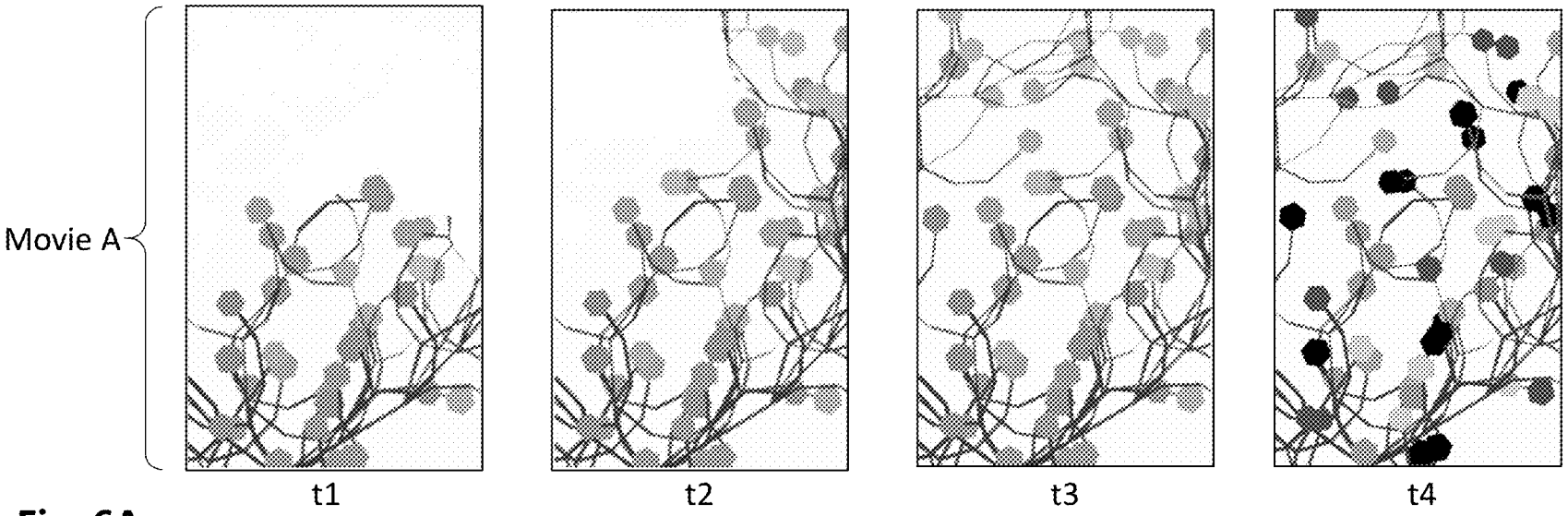
FIGS. 6A-6E show movies that may be determined in accordance with methods described herein.

FIG. 6A shows a movie A that, in an embodiment, may be determined to be presented on the one side of the screen based on light intensity incident on the other side of the screen. FIG. 6A depicts four still images (which may also be referred to as frames or video frames) of movie A, namely a still image for playtime t1, a still image for playtime t2 and a still image for playtime t3 and a still image for playtime t4. In this example, the movie depicts branches with leaves that develop and grow as the movie proceeds. Indeed, at playtime t3 and t4, more branches and leaves are depicted than at playtime t2. Further, the still images for t3 and t4 may be understood to be different versions of the same image. In the image for t4, some of the leaves are darker with respect to the corresponding leaves in the image for t3. Hence, the average brightness value for image t4 is lower than the average brightness value for image t3. Thus, likely, when the image t4 is presented on the screen, more of the incident light intensity will be blocked by the screen.

Determining a movie that is to be presented on the basis of incident light intensity may comprise generating the movie based on a light intensity value indicative of light intensity incident on the other side of the screen. Thus, the determined movie need not be prestored on some computer-readable storage medium but may be generated on the fly. The three still images for t1, t2, t3, t4 may all be determined based on the same light intensity value.

Determining a movie may be understood to comprise determining a plurality of images. Each of these plurality of images may be determined in accordance with the methods described herein. Thus, in contrast to determining entire movie A based on a single light intensity value as per above, it may also be that still image for t1 for movie A is determined based on a first light intensity value, that still image t2 for movie A is determined based on a second light intensity value, that the still image for t3 for movie A is determined based on a third light intensity value and that still image for t3 for movie A is determined based on a fourth light intensity value. These first, second, third and fourth light intensity values may all be different, however, this is not per se the case.

Figure 6B:
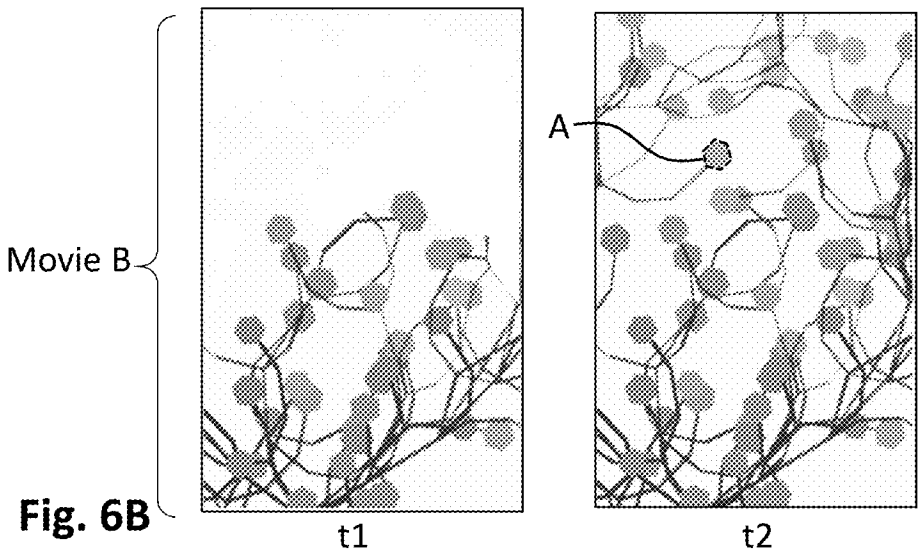

FIG. 6B illustrates a second movie that may be determined to be present on the one side of the screen based on another light intensity, as e.g. indicated by another light intensity value. In movie B of FIG. 6B, the still image for playtime t1 is identical to the still image for playtime t1 for movie A. However, the still image for t2 in movie B is different from the still image for playtime t2 for movie A. In fact, in this example, the still image for t2 in movie B is identical to the still image for t3 in movie A. Thus, in movie B, the branches with leaves are depicted to develop and grow faster than in movie A. Movie B may be a sped up version of movie A. These two movies may be understood to be different because the pair of two still images for the same playtime t2 are different. The still image for t2 in movie B namely has an image element A, in this example depicting a leave, that does not have a corresponding image element in the still image for t2 in movie A. Hence, these images are different and the movies may be understood to be different.

Movie A (and thus each of image t1, image t2, image t3) may be determined to be presented based on a first light intensity value and movie B (thus image t1 and image t2) may be determined to be presented based on a second light intensity value. If the second light intensity as indicated by the second light intensity value is higher than the first light intensity as indicated by the first light intensity value, then, on average, the second video may be darker than the first video. The second video being darker than the first video may be understood as that an average brightness value of the second movie is lower than an average brightness value of the first movie. Determining an average brightness value for a movie may be performed by determining an average of all average brightness values for the respective still images the movie in question. An average brightness value for a still image may be determined in accordance with methods described above.

It should be appreciated that movement and/or growth of image elements as depicted in a movie may also be determined based on incident light intensity on the screen. To illustrate, if the light intensity incident on the other side of the screen is relatively low, then a growth of image elements or growth of a number of image elements may be limited, whereas if the light intensity incident on the screen is relatively high, then a growth of image elements or growth of a number of image elements may be significant. Likewise, if the light intensity incident on the screen is relatively low, then image elements may move significantly in order to create more open, bright regions in still images of the movie herewith increasing the average brightness value for the movie.

Figure 6C:
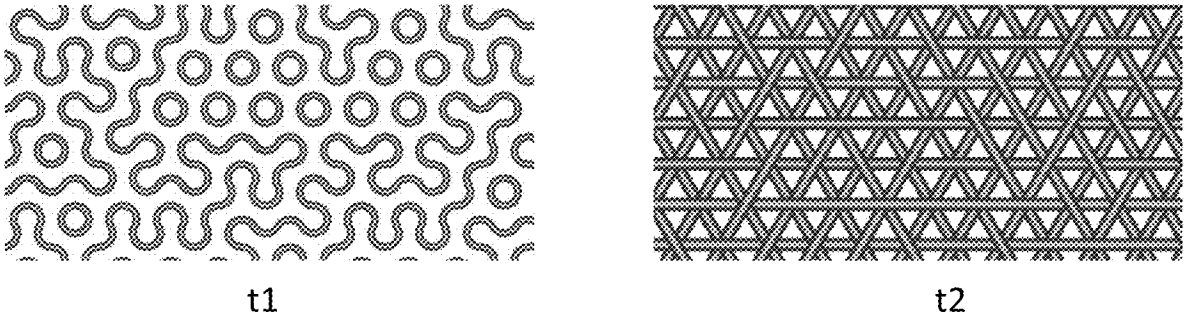
Figure 6D:
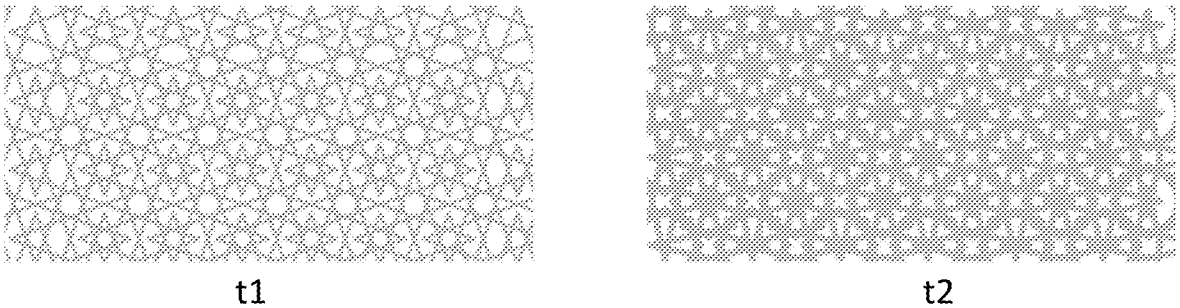
Figure 6E:
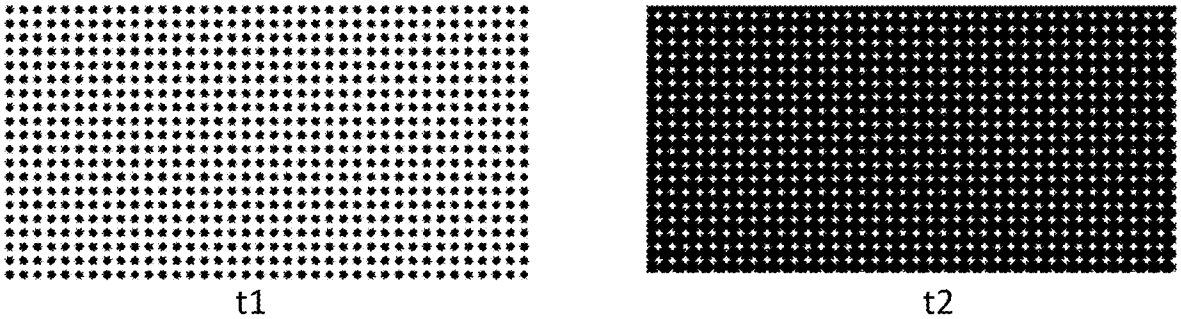

FIGS. 6C, 6D, 6E each shows a first image and a second image that may be determined in accordance with the methods described herein. Again, the pairs of first and second image may both be still images for playtime t1,t2, respectively, for a movie. FIG. 6C, 6D, 6E illustrate that a movie may be generated such that the average brightness values of the still images decreases over time, which would be appropriate if the light intensity incident on the screen would increase. Note that in FIGS. 6C, 6D, 6E the still images for t2 have a lower average brightness value than the still images for t1, for example due to thicker lines, more and/or darker image elements, et cetera.

Figure 7:
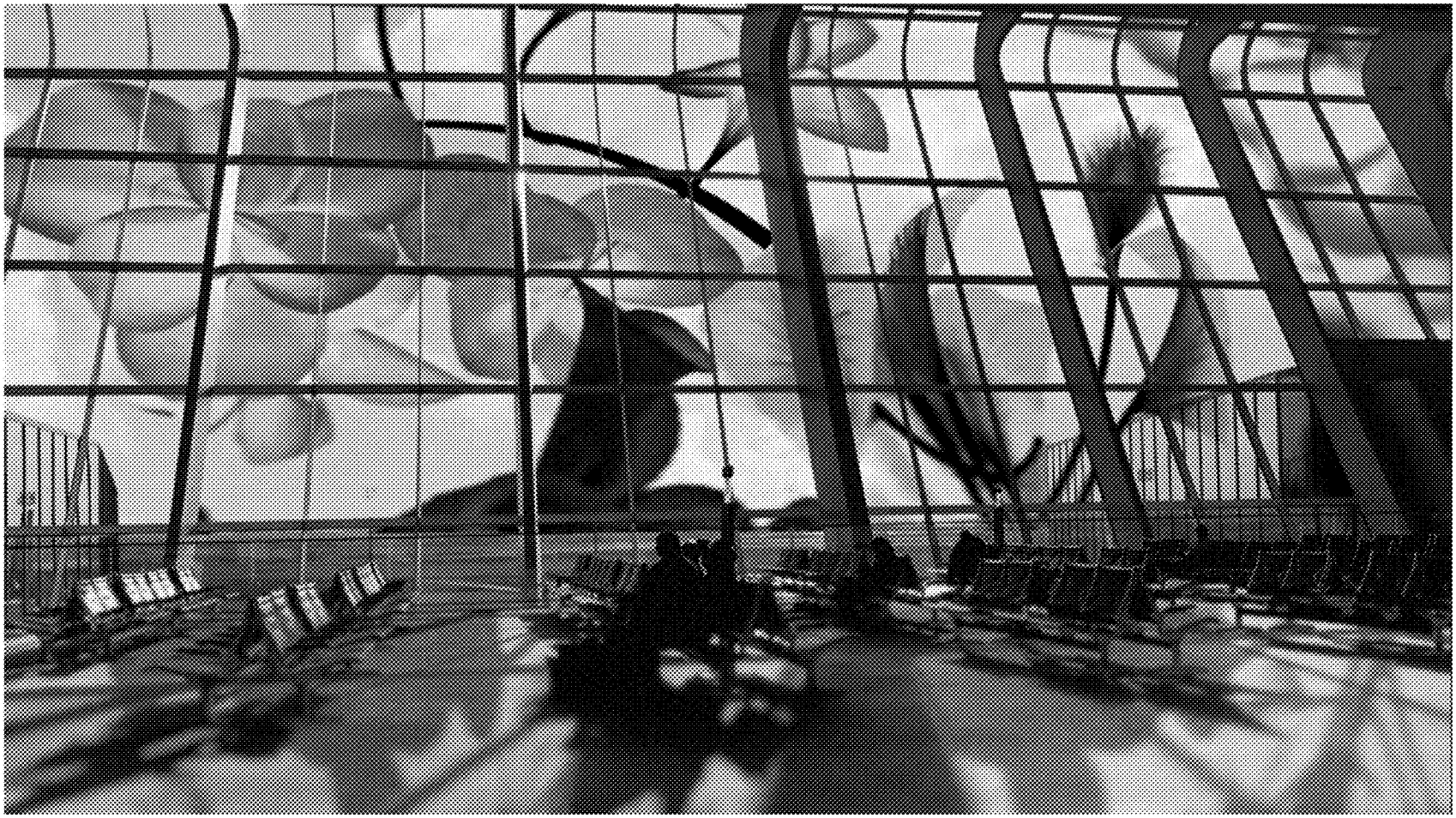
FIG. 7 is an artist impression of the screen of the dynamic shading system presenting an image of plants on the one side of the screen.

FIG. 7 is an artist impression of the screen of the dynamic shading system presenting an image of plants on the one side of the screen.

Figure 8:
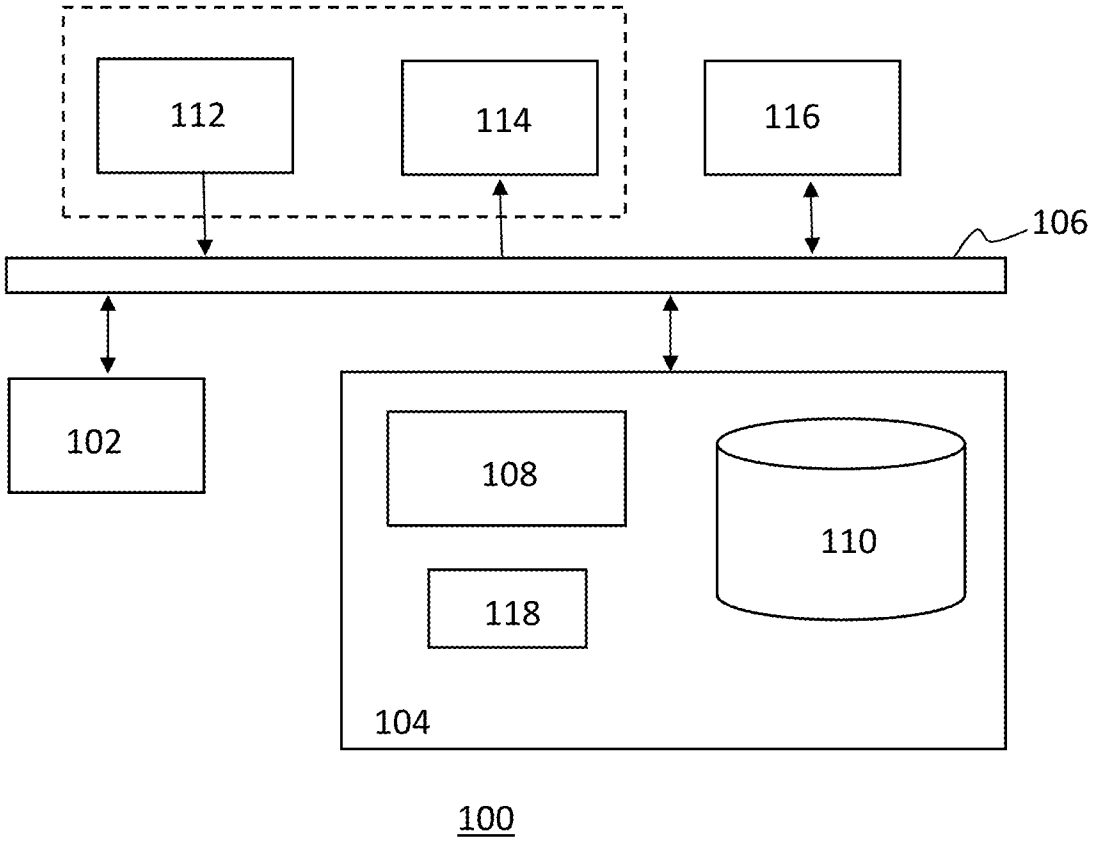
FIG. 8 illustrates a data processing system according to an embodiment.

FIG. 8 depicts a block diagram illustrating a data processing system according to an embodiment.

As shown in FIG. 8, the data processing system 100 may include at least one processor 102 coupled to memory elements 104 through a system bus 106. As such, the data processing system may store program code within memory elements 104. Further, the processor 102 may execute the program code accessed from the memory elements 104 via a system bus 106. In one aspect, the data processing system may be implemented as a computer that is suitable for storing and/or executing program code. It should be appreciated, however, that the data processing system 100 may be implemented in the form of any system including a processor and a memory that is capable of performing the functions described within this specification.

The memory elements 104 may include one or more physical memory devices such as, for example, local memory 108 and one or more bulk storage devices 110. The local memory may refer to random access memory or other non-persistent memory device(s) generally used during actual execution of the program code. A bulk storage device may be implemented as a hard drive or other persistent data storage device. The processing system 100 may also include one or more cache memories (not shown) that provide temporary storage of at least some program code in order to reduce the number of times program code must be retrieved from the bulk storage device 110 during execution.

Input/output (I/O) devices depicted as an input device 112 and an output device 114 optionally can be coupled to the data processing system. Examples of input devices may include, but are not limited to, a keyboard, a pointing device such as a mouse, a touch-sensitive display, a light intensity sensor described herein or the like. Examples of output devices may include, but are not limited to, a monitor or a display, speakers, a screen and in particular light valves described herein, or the like. Input and/or output devices may be coupled to the data processing system either directly or through intervening 1/O controllers.

In an embodiment, the input and the output devices may be implemented as a combined input/output device (illustrated in FIG. 8 with a dashed line surrounding the input device 112 and the output device 114). An example of such a combined device is a touch sensitive display, also sometimes referred to as a "touch screen display" or simply "touch screen". In such an embodiment, input to the device may be provided by a movement of a physical object, such as e.g. a stylus or a finger of a user, on or near the touch screen display.

A network adapter 116 may also be coupled to the data processing system to enable it to become coupled to other systems, computer systems, remote network devices, and/or remote storage devices through intervening private or public networks. The network adapter may comprise a data receiver for receiving data that is transmitted by said systems, devices and/or networks to the data processing system 100, and a data transmitter for transmitting data from the data processing system 100 to said systems, devices and/or networks. Modems, cable modems, and Ethernet cards are examples of different types of network adapter that may be used with the data processing system 100.

As pictured in FIG. 8, the memory elements 104 may store an application 118. In various embodiments, the application 118 may be stored in the local memory 108, the one or more bulk storage devices 110, or apart from the local memory and the bulk storage devices. It should be appreciated that the data processing system 100 may further execute an operating system (not shown in FIG. 8) that can facilitate execution of the application 118. The application 118, being implemented in the form of executable program code, can be executed by the data processing system 100, e.g., by the processor 102. Responsive to executing the application, the data processing system 100 may be configured to perform one or more operations or method steps described herein.

In one aspect of the present invention, the data processing system 100 may represent a control system as described herein.

Various embodiments of the invention may be implemented as a program product for use with a computer system, where the program(s) of the program product define functions of the embodiments (including the methods described herein). In one embodiment, the program(s) can be contained on a variety of non-transitory computer-readable storage media, where, as used herein, the expression "non-transitory computer readable storage media" comprises all computer-readable media, with the sole exception being a transitory, propagating signal. In another embodiment, the program(s) can be contained on a variety of transitory computer-readable storage media. Illustrative computer-readable storage media include, but are not limited to: (i) non-writable storage media (e.g., read-only memory devices within a computer such as CD-ROM disks readable by a CD-ROM drive, ROM chips or any type of solid-state non-volatile semiconductor memory) on which information is permanently stored; and (ii) writable storage media (e.g., flash memory, floppy disks within a diskette drive or hard-disk drive or any type of solid-state random-access semiconductor memory) on which alterable information is stored. The computer program may be run on the processor 102 described herein.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of embodiments of the present invention has been presented for purposes of illustration, but is not intended to be exhaustive or limited to the implementations in the form disclosed. Many modifications and variations will be apparent to those of ordinary skill in the art without departing from the scope and spirit of the present invention. The embodiments were chosen and described in order to best explain the principles and some practical applications of the present invention, and to enable others of ordinary skill in the art to understand the present invention for various embodiments with various modifications as are suited to the particular use contemplated.

What is claimed is:

1. A dynamic shading system comprising a screen comprising a plurality of light valves, each light valve having an adjustable translucency so that the screen can present an image on one side of the screen; and a control system that is configured to determine what image is to be presented on the one side of the screen in dependence of light intensity incident on another side of the screen, and to control each light valve of the screen to have a translucency so that the plurality of the light valves forms the determined image on the one side of the screen, wherein the control system is configured to perform steps of obtaining a first light intensity value indicative of a first light intensity incident on the other side of the screen, determining, based on the first light intensity value, a first to-be-presented image, controlling each light valve of the screen to have a translucency so that the plurality of the light valves forms the first image on the one side of the screen, obtaining a second light intensity value indicative of a second light intensity incident on the other side of the screen, the second light intensity value being different from the first light intensity value, determining, based on the second light intensity value, a second to-be-presented image, the second image being different from the first image, and controlling each light valve of the screen to have a translucency so that the plurality of light valves forms the second image on the one side of the screen, wherein the first and second image each comprises one or more image elements formed by adjacent image pixels having the same or similar pixel values, each image element having a respective size and shape and relative position within the image in question, wherein the first and second image differ in that a particular image element in the second image, the particular image element having a particular size and particular shape and particular relative position, does not have in the first image a corresponding image element having the same particular size and the same particular shape and the same particular relative image position.

2. The dynamic shading system according to claim 1, wherein determining the first to-be-presented image comprises determining a first set of image pixel values comprising, for each light valve of the screen, a greyscale value, the first set of image pixel values representing the first image, and determining the second to-be-presented image comprises determining a second set of image pixel values comprising, for each light valve of the screen, an image pixel value, the second set of image pixel values representing the second image.

3. The dynamic shading system according to claim 1, wherein the control system is configured to perform a step of determining, for each light valve out of the plurality of light valves, a first translucency value, wherein controlling each light valve of the screen to have a translucency so that the plurality of the light valves forms the first image on the one side of the screen is performed based on the first translucency values determined for the respective light valves, and the control system is configured to perform a step of determining, for each light valve out of the plurality of light valves, a second translucency value, wherein controlling each light valve of the screen to have a translucency so that the plurality of the light valves forms the second image on the one side of the screen is performed based on the second translucency values determined for the respective light valves.

4. The dynamic shading system according to claim 3, wherein the first translucency value for each light valve is determined on the basis of a light intensity value indicative of light intensity incident on the other side of the screen when the plurality of the light valves will form the first image on the one side of the screen and the second translucency value for each light valve is determined on the basis of a light intensity value indicative of light intensity incident on the other side of the screen when the plurality of the light valves will form the second image on the one side of the screen.

5. The dynamic shading system according to claim 1, wherein the second light intensity as indicated by the second light intensity value is higher than the first light intensity as indicated by the first light intensity value, wherein on average the second image is darker than the first image.

6. The dynamic shading system according to claim 1, wherein the control system is configured to determine what movie is to be presented on the one side of the screen in dependence of light intensity on the other side of the screen, and wherein the control system is configured to perform steps of determining, based on the first light intensity value, a first to-be-presented movie comprising a first set of successively presented images, the first set of successively presented images comprising the first to-be-presented image, and controlling each light valve of the screen to sequentially have first translucencies so that the plurality of the light valves forms the first movie on the one side of the screen, and determining, based on the second light intensity value, a second to-be-presented movie different from the first to-be-presented movie, the second to-be-presented movie comprising a second set of successively presented images, the second set of successively presented images comprising the second to-be-presented image, and controlling each light valve of the screen to sequentially have second translucencies so that plurality of light valves forms the second movie on the one side of the screen.

7. The dynamic shading system according to claim 6, wherein the second light intensity as indicated by the second light intensity value is higher than the first light intensity as indicated by the first light intensity value, wherein on average, the second video is darker than the first video.

8. The dynamic shading system according to claim 7, wherein determining the first movie comprises generating the first movie based on the first light intensity value and/or wherein determining the second movie comprises generating the second movie based on the second light intensity value.

9. The dynamic shading system according to claim 1, wherein the first and/or second image depicts one or more plants and/or animals.

10. The dynamic shading system according to claim 1, the second light intensity as indicated by the second light intensity value is higher than the first light intensity as indicated by the first light intensity value, and wherein the first movie and the second movie depict growth of one or more plants, wherein the depicted growth in the second video is faster than the depicted growth in the first video.

11. The dynamic shading system according to claim 1, wherein each light valve comprises a liquid crystal display (LCD) pixel.

12. The dynamic shading system according to claim 1, further comprising a light intensity sensor for measuring light intensity incident on the other side of the screen.

13. A computer-implemented method for determining images that are to be presented on a side of a screen in dependence of light intensity incident on another side of the screen, the screen comprising a plurality of light valves, each light valve having an adjustable translucency so that the screen can present an image on one side of the screen, the method comprising:

obtaining a first light intensity value indicative of a first light intensity incident on the other side of the screen, determining, based on the first light intensity value, a first to-be-presented image, controlling each light valve of the screen to have a translucency so that the plurality of the light valves forms the first image on the one side of the screen, obtaining a second light intensity value indicative of a second light intensity incident on the other side of the screen, the second light intensity value being different from the first light intensity value, determining, based on the second light intensity value, a second to-be-presented image, the second image being different from the first image, and controlling each light valve of the screen to have a translucency so that the plurality of light valves forms the second image on the one side of the screen, wherein the first and second image each comprises one or more image elements formed by adjacent image pixels having the same or similar pixel values, each image element having a respective size and shape and relative position within the image in question, wherein the first and second image differ in that a particular image element in the second image, the particular image element having a particular size and particular shape and particular relative position, does not have in the first image a corresponding image element having the same particular size and the same particular shape and the same particular relative image position.

14. A non-transitory computer-readable storage medium having stored thereon a computer program comprising instructions which, when the program is executed by a computer, cause the computer to carry out the method of claim 13.

* * * * *